United States Patent [19]

Hauk

[11] 4,099,429

[45] Jul. 11, 1978

[54] PIPE-SPINNING APPARATUS AND METHOD

[75] Inventor: Ernest D. Hauk, Signal Hill, Calif.

[73] Assignee: Service Equipment Design Co., Inc., Signal Hill, Calif.

[21] Appl. No.: 615,597

[22] Filed: Sep. 22, 1975

Related U.S. Application Data

[63] Continuation of Ser. No. 238,069, Mar. 27, 1972, abandoned.

[51] Int. Cl.[2] ..... B25B 13/52

[52] U.S. Cl. ..... 81/57.17; 81/57.14; 81/57.2; 166/78

[58] Field of Search ..... 81/53 R, 57.14, 57.16, 81/57.17, 57.19, 57.2; 166/77.5, 78, 85; 173/163, 164

[56] References Cited

U.S. PATENT DOCUMENTS

| | | | |
|---|---|---|---|
| 1,639,710 | 8/1927 | Stowell | 81/57.17 |
| 2,353,642 | 7/1944 | Buice | 81/57.17 |
| 2,784,626 | 3/1957 | Paget | 81/53 R |
| 2,862,690 | 12/1958 | Mason | 81/57.17 |

*Primary Examiner*—James L. Jones, Jr.
*Assistant Examiner*—James G. Smith
*Attorney, Agent, or Firm*—Richard L. Gausewitz

[57] ABSTRACT

According to the present apparatus and method, a silent chain having an inversely-bent internal portion is caused to be in direct pressure engagement with the external cylindrical surface of a drill pipe or other object to be spun. The chain is mounted on at least five sprocket wheels, one of which is a drive wheel adapted to rotate about a movable axis which may be locked in any desired adjusted position. The pressure between chain and pipe is caused to be sufficient to spin the pipe but insufficient to injure the pipe or prevent relative sliding movement when the joint is completed. A spring is provided to absorb shock on completion of the joint, and to cooperate with the relative sliding movement in preventing injury to the apparatus or to any user thereof. The chain is caused to encompass a very large section of the diameter of the pipe, regardless of variations in pipe diameter. At least for some sizes of pipe, the pivot points of the apparatus are so arranged that the chain tension operates to maintain the jaws closed instead of attempting to open the same, whereby to minimize the possibility of the tool "climbing off" the pipe. A pneumatic circuit is provided to insure that adequate pipe-engaging pressure is maintained despite loss of air pressure due to operation of a pneumatic spinning motor.

23 Claims, 13 Drawing Figures

FIG. 1.
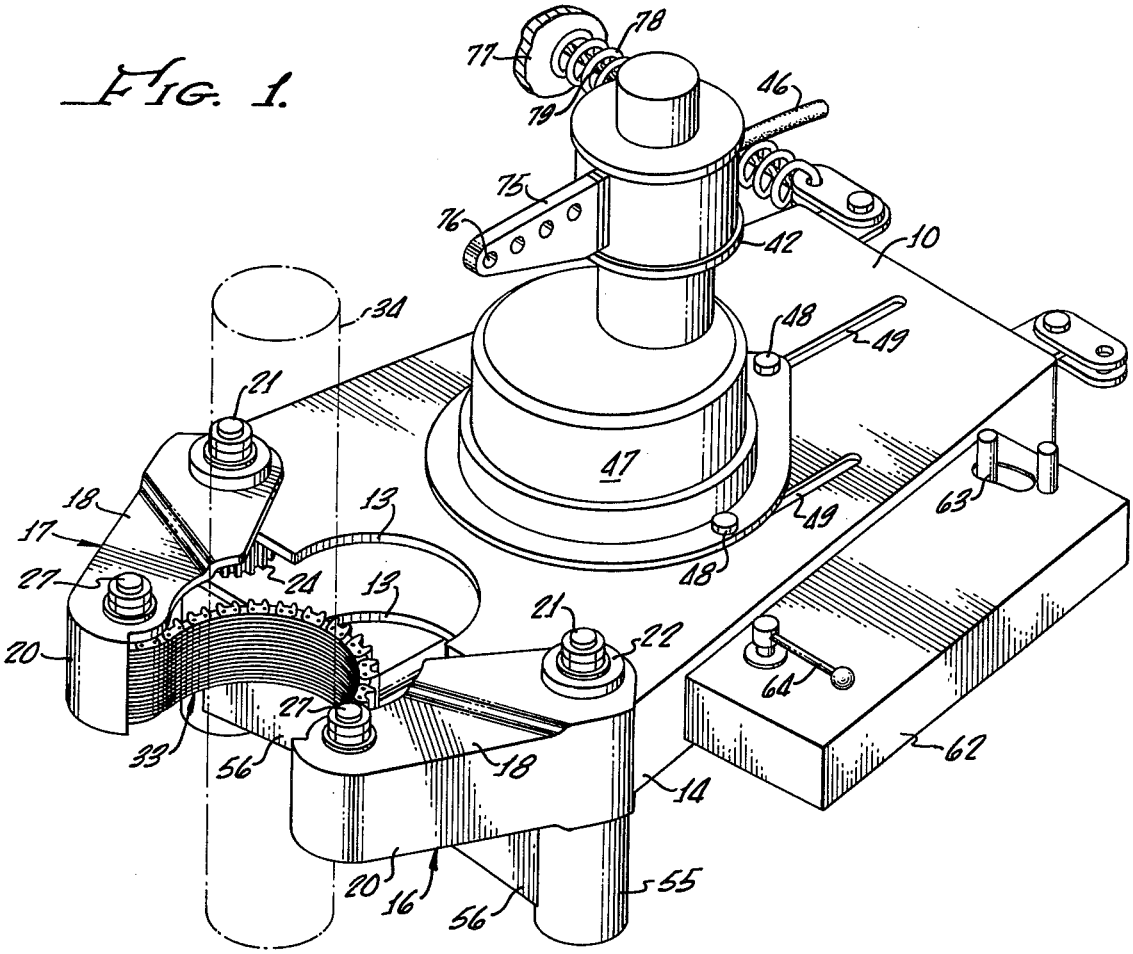
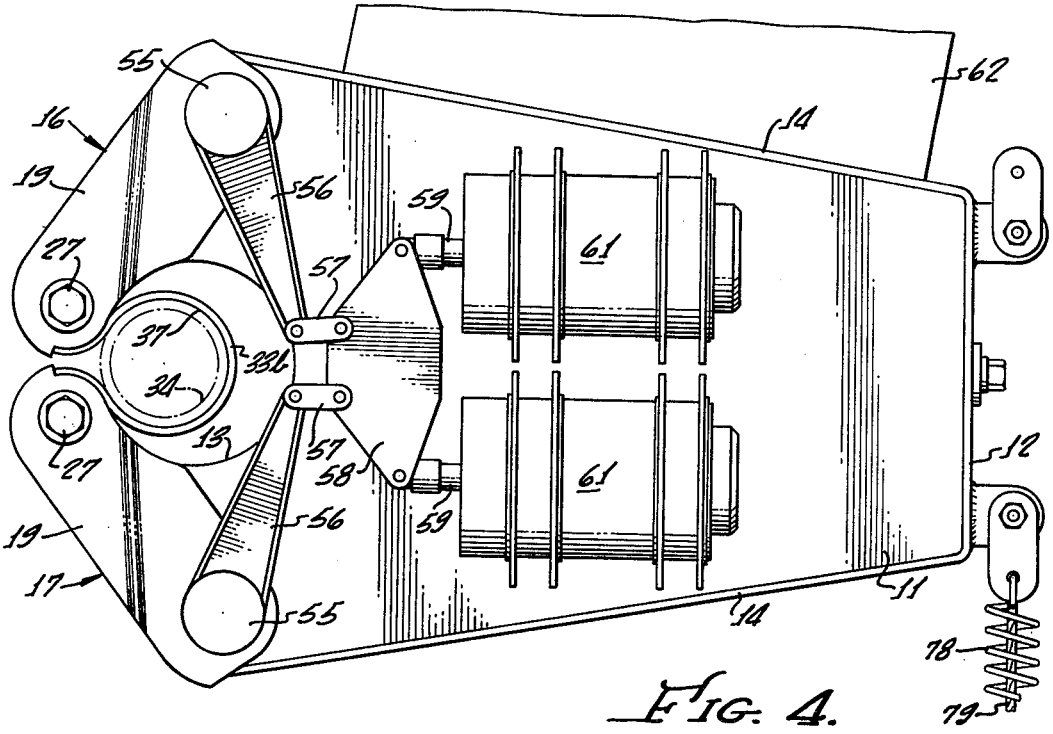
FIG. 4.

FIG. 9.
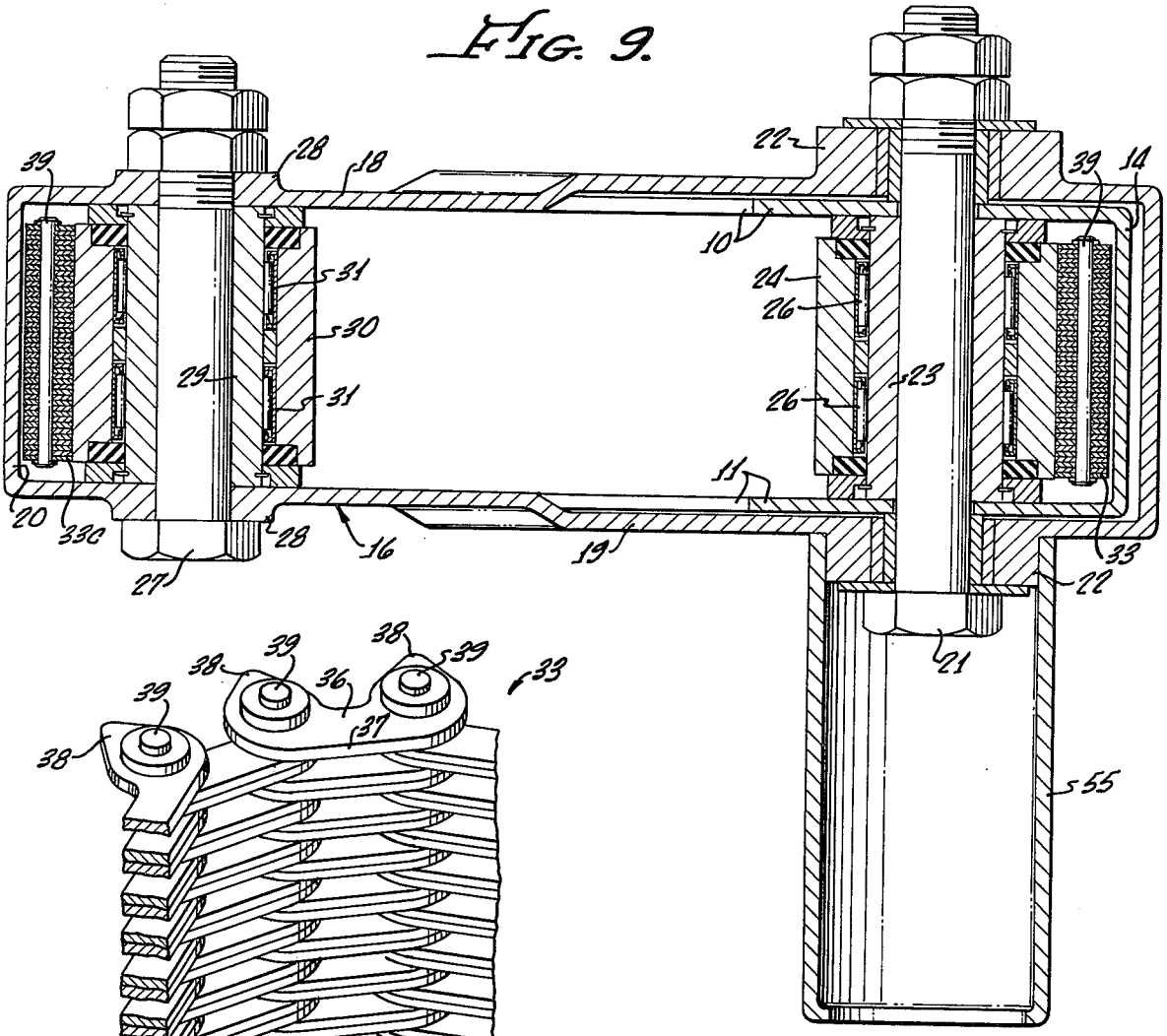
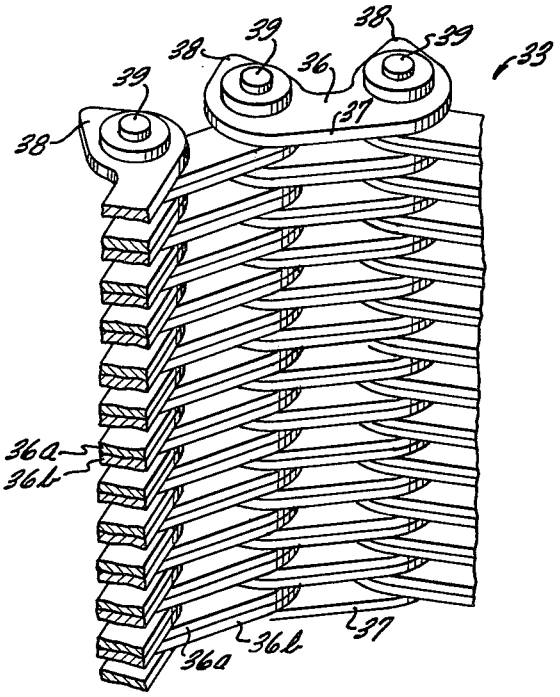
FIG. 10.
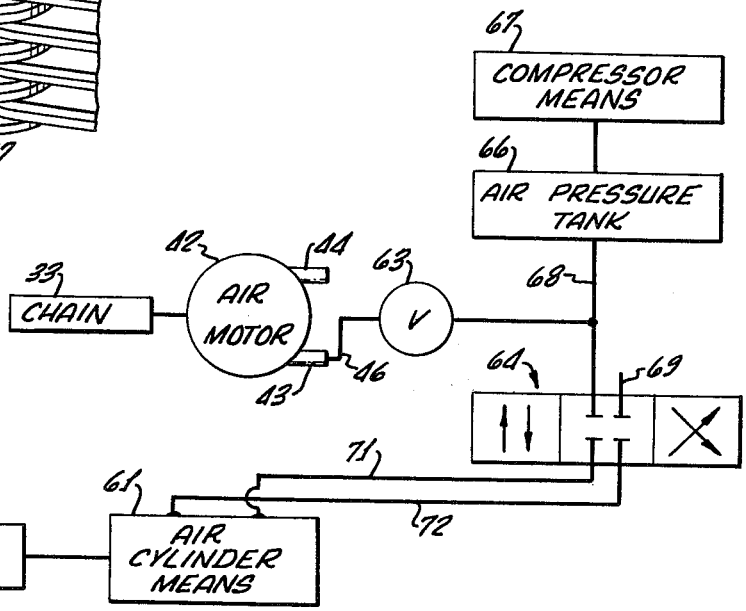
FIG. 11.

PIPE-SPINNING APPARATUS AND METHOD

CROSS REFERENCE TO RELATED APPLICATION

This application is a continuation of my pending patent application Ser. No. 238,069, filed Mar. 27, 1972, now abandoned for Pipe-Spinning Apparatus and Method.

BACKGROUND OF THE INVENTION

1. Field of the Invention

This invention relates to the field of apparatus and methods for rotating substantially cylindrical objects, particularly drill pipe, drill collars, casing, etc. The word "cylindrical" is employed in this specification in its ordinary or common sense, namely to define objects which have a circular or substantially circular exterior cross-sectional shape.

2. Description of Prior Art

In making joints between sections of the drill pipe used in drilling oil wells, and in disconnecting such joints, it is conventional practice to spin the drill pipe (rotate the same about the longitudinal axis thereof) by the following method: A length of chain is wrapped a number of times around the drill pipe, and one end of the chain is pulled. The chain then disengages the pipe and becomes a very dangerous moving object which may effect injury to the workmen. Because of such danger, because of the slowness of the operation, and because of other factors, large numbers of prior-art workers have attempted to provide automatic apparatus which will do the job successfully, rapidly, etc. The results of such prior-art efforts have not achieved widespread commercial success, so that the above-indicated archaic method of spinning pipe prevails to this day.

Prior-art U.S. patents for effecting spinning or rotation of drill pipe, etc., and which are known to applicant, are the following: Nos. 1,639,710; 1,760,167; 1,805,007; 1,925,970; 2,450,934; 2,460,671; 2,523,159; 2,544,639; 2,573,212; 2,615,681; 2,650,070; 2,741,460; 2,746,329; 2,760,392; 2,784,626; 2,862,690; 2,928,301; 3,061,011; and 3,308,691.

Some of the above-specified patents provide intermediate members between the chain (or other drive means) and the pipe to be spun, which is highly undesirable for reasons including (among others) excessive wear on such intermediate members. The remaining patents effect direct engagement between a chain or a belt and the exterior cylindrical surface of the pipe to be spun. The chains employed are frequently in the nature of bicycle chains, ordinary link-chains, etc., which often have teeth thereon disposed to bite into the pipe surface. For various reasons, including excessive wear, injury to the pipe, unsatisfactory operation, etc., all of such chains and belts have proved to be unsatisfactory.

There has been known for decades a type of chain termed a "silent chain", and it has had wide application in industry. However, to the best knowledge of applicant, no prior-art worker has employed a silent chain for the direct frictional gripping (under pressure) and then spinning of a drill pipe or other cylindrical object. One prior-art worker has, as taught by U.S. No. 2,353,642, employed a silent chain to turn non-cylindrical objects, namely nuts and bolts, the relationship being such that the individual links of the chain fit against the faces of a nut or a bolt head (whether it be square or hexagonal). The indicated prior-art patent did not suggest, or provide any means to achieve, frictional gripping of a cylindrical object to be rotated.

The prior-art apparatus and methods known to applicant are also deficient in other major respects. These frequently include (for example): (1) mounting the chain completely around the pipe, so that the chain must be broken prior to each spinning operation, (2) mounting the chain-drive motor and sprocket by means of a weak spring, instead of fixedly in any adjusted position, so that inadequate chain tension was developed, (3) mounting the chain on only three sprockets, which were so located that the chain tension created large torques tending to open the jaws and permit release of the pipe, (4) requiring some locking-connector means to lock the jaws closed, and which must be connected and disconnected between spinning operations, (5) requiring pipe-engaging teeth on the chains, which teeth wore the pipe excessively and also prevented desirable clutching action from occurring when the joint seated, (6) failing to compensate properly for the tendency of the spinning apparatus to rotate when the joint seats, (7) failing to grip a sufficiently large proportion of the pipe circumference, (8) failing to adequately control and equalize the jaw-closing mechanisms, (9) failing to compensate for depletion of air in the pneumatic supply, and (10) failing to generate sufficient torque.

SUMMARY OF THE INVENTION

In accordance with one aspect of the apparatus and method, a silent chain is formed into a closed loop having an external portion and also having an inverse internal portion. The external and internal chain portions connect to each other at return-bent portions. The pipe to be spun is disposed within the internal chain portion, the return-bent portions are moved relatively close to each other so that a very large portion of the pipe circumference is engaged, and great tension is applied to the chain to cause it to friction-grip the pipe despite the presence of water or oil on the pipe surface. The chain is then driven to spin the pipe in the desired direction.

In accordance with another aspect of the apparatus and method, the return-bent portions of a drive chain are mounted on sprockets on pivoted jaws. The pivot points of the jaws are correlated to various factors in such manner that increasing the chain tension effects (at least for some sizes of pipes) increase in the force tending to close the jaws, the result being that the spinning apparatus cannot climb off (disengage) the pipe until such action is desired by the operator.

The tension applied to the chain is, in accordance with another aspect of the apparatus and method, caused to be sufficient to effectively and rapidly spin the pipe but insufficient to prevent the chain from slipping relative to the pipe when the joint seats (becomes closed). Accordingly, and because the spinning apparatus is anchored by a resilient means instead of fixedly, there is no damage to the tool and personnel when the joint seats.

The drive motor is adjustable to any desired position, to thus adapt the apparatus for spinning different sizes of pipe. However, the motor mounting means are such that the motor is rigidly locked in the desired adjusted position, thereby permitting great chain tension to be achieved by shifting the return-bent chain portions toward each other. Furthermore, there is no chain tension until the pipe is gripped, so that moving the spinning tool into encompassing relationship to the pipe is greatly facilitated.

The jaws of the spinning apparatus are, in accordance with a further aspect of the apparatus and method, disposed at at least a predetermined large included angle to each other, and the various adjustments are caused to be such that the return-bent chain portions are close together. The large included angle combines with the close spacing to create an efficient chain-gripping action and to lock the pipe in the spinning apparatus.

The jaws are preferably pneumatically operated, and the chain pneumatically driven. The apparatus and method comprise locking air in the jaw cylinders so that depletion of the air supply does not permit the chain to climb off the pipe. The apparatus also provides effective adjusting and locking means, linkage means, etc., for adjusting the chain and for equalizing the jaw-closing operations.

BRIEF DESCRIPTION OF THE DRAWINGS

FIG. 1 is an isometric view showing a pipe-spinning tool constructed in accordance with the present invention, in open condition prior to gripping around the pipe (which is shown in phantom);

FIG. 4 is a bottom plan view showing the apparatus when in the pipe-gripping position of FIG. 3;

FIG. 9 is an enlarged fragmentary sectional view taken on line 9—9 of FIG. 8;

FIG. 10 is an enlarged fragmentary isometric view illustrating a portion of the silent chain;

FIG. 11 is a schematic diagram showing the pneumatic circuit of the apparatus;

DESCRIPTION OF THE PREFERRED EMBODIMENTS

Throughout this specification, the apparatus and method will be described in relation to a drill pipe, although drill collars and other types of cylindrical or substantially cylindrical objects may be spun as indicated above. The words "spin-up" are sometimes employed to denote a relationship whereby one section of drill pipe is rotated about its longitudinal axis in a direction which closes or completes the joint to another section of drill pipe. Conversely, the words "spin-out" are sometimes employed to denote the direction of rotation whereby a joint is disconnected or broken.

Figure 7:
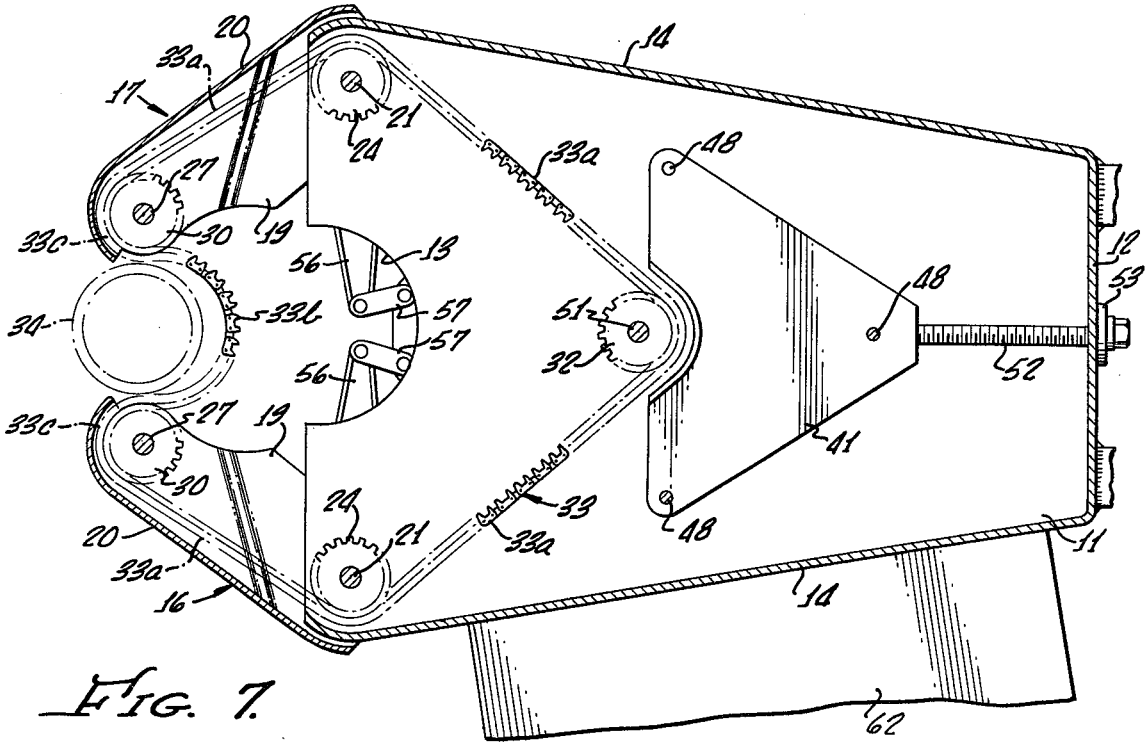
FIGS. 7 and 8 are horizontal sectional views taken on line 7—7 of FIG. 2, and showing the jaws in two different positions.
Figure 8:
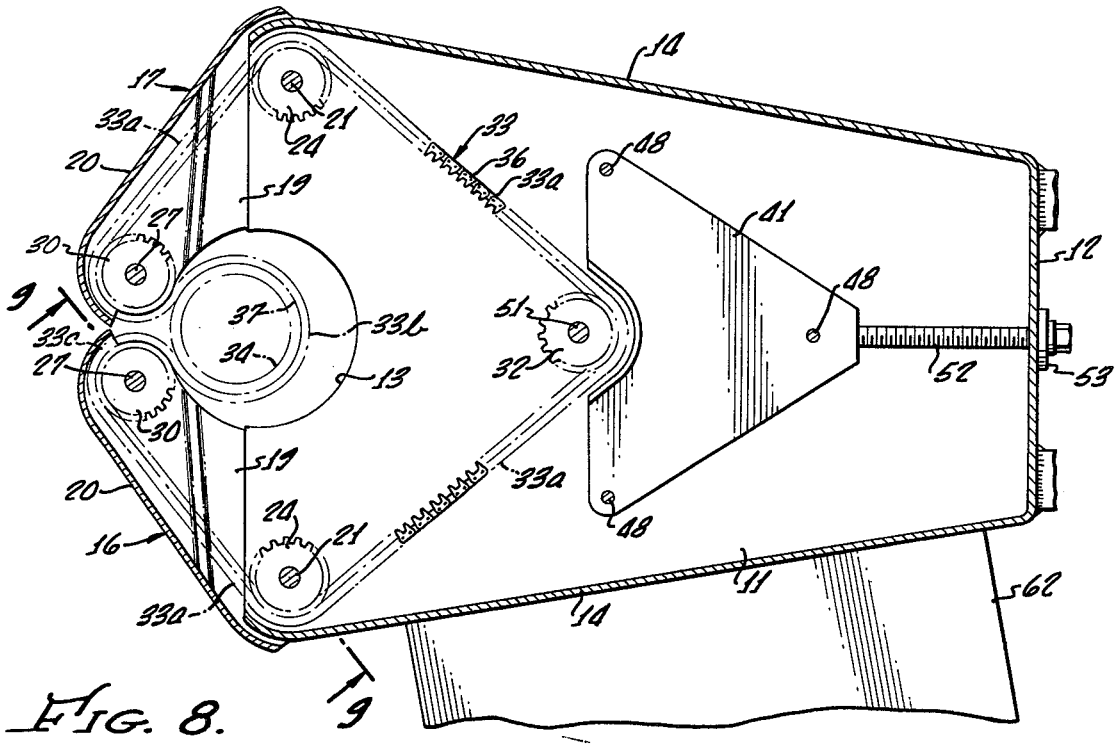

Referring to the drawings, the apparatus comprises a main housing which is generally trapezoidal in shape and has upper and lower parallel walls 10 and 11, respectively. The narrow end of the housing is closed by an end wall 12, whereas the wide end or base of the housing is open. At the central region of the wide end of the housing, upper and lower walls 10 and 11 are correspondingly recessed at 13 to provide clearance for various sizes of pipe to be spun. The housing also has side walls 14, as best illustrated in FIGS. 7 and 8.

The apparatus further comprises a pair of jaws 16 and 17 each of which is generally channel sectioned. The upper and lower flanges 18 and 19 of the jaws fit, respectively, above and below the housing walls 10 and 11. The side wall or web 20 of each jaw is disposed toward the outside of the apparatus, as distinguished from being disposed adjacent the recesses 13, and is so located that it does not interfere with pivotal movement of the jaws.

As best shown in FIG. 9, each jaw 16 and 17 is pivotally connected to the main housing (at one end of the base portion thereof) by means of a vertical pivot volt 21 which extends through boss portions 22 of flanges 18 and 19. Bolt 21 also extends through apertures in housing walls 10 and 11, and through a sleeve 23 which seats between such housing walls. A sprocket wheel 24 is rotatably mounted around sleeve 23 by means of roller bearings 26. Suitable spacer means are provided to center the sprocket wheel 24, and sealing means are provided to seal lubricant in the roller bearings.

A similar sprocket wheel assembly is provided at the outer end of each jaw 16 and 17, as shown at the left in FIG. 9. Each such assembly comprises a vertical pivot bolt 27, boss portions 28, sleeve 29, sprocket wheel 30, and roller bearings 31.

As best illustrated in FIGS. 7 and 8, the various sprocket wheels 24 and 30 are disposed equal distances on opposite sides of a vertical plane (the "medial plane") which passes through the center of the main housing and which contains the axis of the pipe to be spun. The vertical axis of a drive sprocket wheel 32 is also disposed in such plane, such wheel being spaced a substantial distance away from recesses 13 and being adjustably located between the upper and lower housing walls 10 and 11 as described in detail hereinafter.

A chain 33 (which is one type of "flexible drive element") is mounted around all of the sprocket wheels 24, 30 and 32, as shown in FIGS. 7 and 8, and is a closed loop. Chain 33 has an external portion **33*a* which meshes with the outer portions of all five of the sprocket wheels, and further has an internal portion 33*b* which is inversely bent between the two sprocket wheels 30 and extends rearwardly toward sprocket wheel 32**.

The inverse internal portion **33*b* is adapted, when the jaws 16 and 17 are in the open condition shown in FIG. 7, to be moved into a position around a pipe (such as a drill pipe or drill collar) 34 to be spun, so that closing of the jaws 16 and 17 creates pressure engagement of the inverse internal portion 33*b* with the external cylindrical pipe surface as shown in FIG. 8. The external and internal chain portions 33*a* and 33*b* connect to each other at return-bent portions 33*c* which extend around the sprocket wheels 30 at the outer ends of jaws 16 and 17**.

It is an important feature of one aspect of the present apparatus and method that the chain 33 is a "silent chain", which is a recognized term for an inverted-tooth chain made up of a large number of corresponding planar leaf links 36 the ends of which overlap each other in alternating relationship as shown in FIG. 10. Each leaf link has an inner bearing edge 37 adapted to engage the pipe 34, and also has at each end thereof (and on the side opposite edge 37) a pair of sprocket teeth 38 which are shaped to mesh with the various sprocket wheels 24, 30 and 32. The bearing edges 37 of the various links are shown as being substantially straight, but they may also be slightly concave in order to conform more closely to the exterior surface of pipe 34.

In the illustrated silent chain 33, the various leaf links 36 are disposed in pairs, such as 36*a* and 36*b*, which are coextensive, parallel, and in surface contact with each other. Large numbers of such pairs are disposed in what may be termed layers, in the alternating relationship shown in FIG. 10. Pivot pins 39 extend through the end portions of the leaf links to hold the chain together in pivotal relationship.

The silent chain 33 (and the sprocket wheel teeth) are preferably constructed in accordance with American Society of Automotive Engineers Standard B29.2. Such chain is well known in industry, being desirable for various purposes because of its silent operation, strength, durability, etc. In accordance with the present apparatus and method, the relatively silent operation of the chain is not a factor, the purpose being instead to create large bearing areas at the inner leaf edges 37 and which engage the external cylindrical surface of the pipe 34 to be spun.

When a chain is employed having the indicated leaf edges 37, and the large bearing area, it is not necessary to provide teeth on the inner surfaces of the chain (the pipe-engaging surfaces thereof), so that there is a minimum possibility of damage to the pipe. Furthermore, when no pipe-engaging teeth are employed, the chain may more readily slip relative to the pipe when the joint seats or bottoms out, thereby preventing damage to the spinning apparatus as described subsequently.

The use of the silent chain in combination with the very large jaw-closing pressures indicated below, permit the spinning apparatus to create a sufficient torque to spin large pipes at high speed, despite the presence of water, oil, etc., on the pipe. One advantage of the silent chain is that it is substantially incapable of being stretched. Furthermore, it is a primary advantage that the pipe is spun without any substantial damage thereto.

Referring to FIGS. 7–9, inclusive, it is pointed out that portions of the side walls 14 and 20 are bent around sprocket wheels 24 and 30, in sufficiently close proximity to chain 33 that it is impossible for the chain to become disengaged from the teeth-cut grooves in the sprocket wheels. Furthermore, a chain guide and locking element 41 (FIGS. 6–8) is provided between housing walls 10 and 11 and sufficiently close to drive sprocket wheel 32 that the chain may not disengage the latter. Because the presence of the various chain guide means, there is no need to maintain tension on the chain in order to prevent it from disengaging the sprocket wheels. In fact, no malfunctions or damage results even if the chain is driven when there is no pipe 34 in the apparatus, regardless of whether the jaws 16 and 17 are open or closed.

Figure 2:
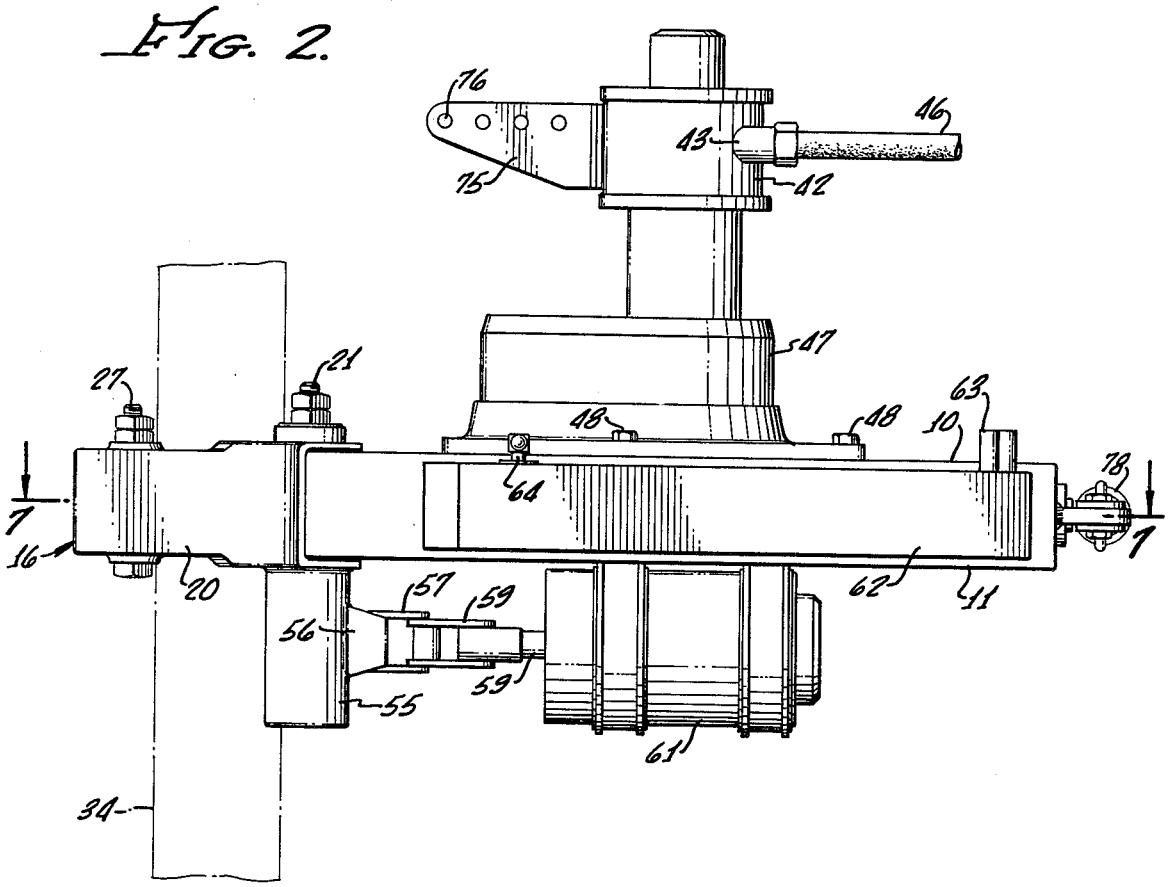
FIG. 2 is a side elevational view of the tool.
Figure 3:
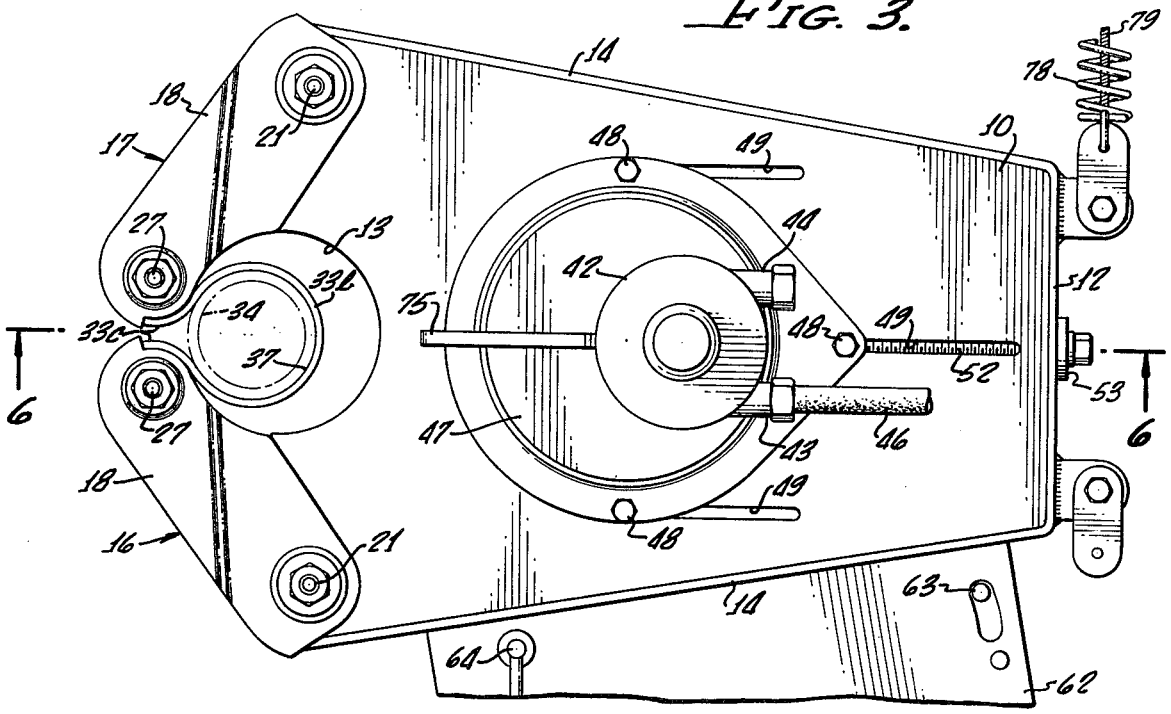
FIG. 3 is a top plan view thereof, showing the jaws in closed condition around the pipe.
Figure 5:
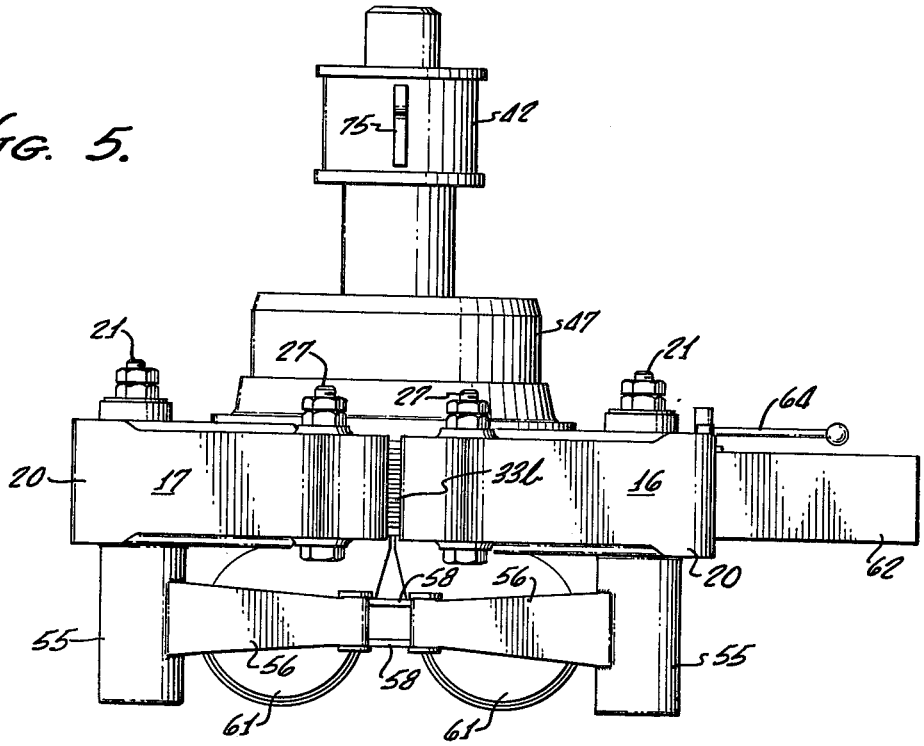
FIG. 5 is a front elevational view of the apparatus.

Proceeding next to a description of the means for driving chain 33, and for adjusting the chain to accommodate different diameters of pipes 34, this comprises a pneumatic rotary motor 42 having first and second air ports 43 and 44 (FIG. 3). When it is desired to operate the motor 42 in one direction, an air hose 46 is connected to port 43 whereupon port 44 serves as a vent or exhaust. Conversely, when it is desired to reverse the direction of rotation the hose 46 is connected to port 44 so that port 43 serves as a vent. For this purpose, a suitable quickconnect fitting is provided at the end of the air hose 46.

Figure 6:
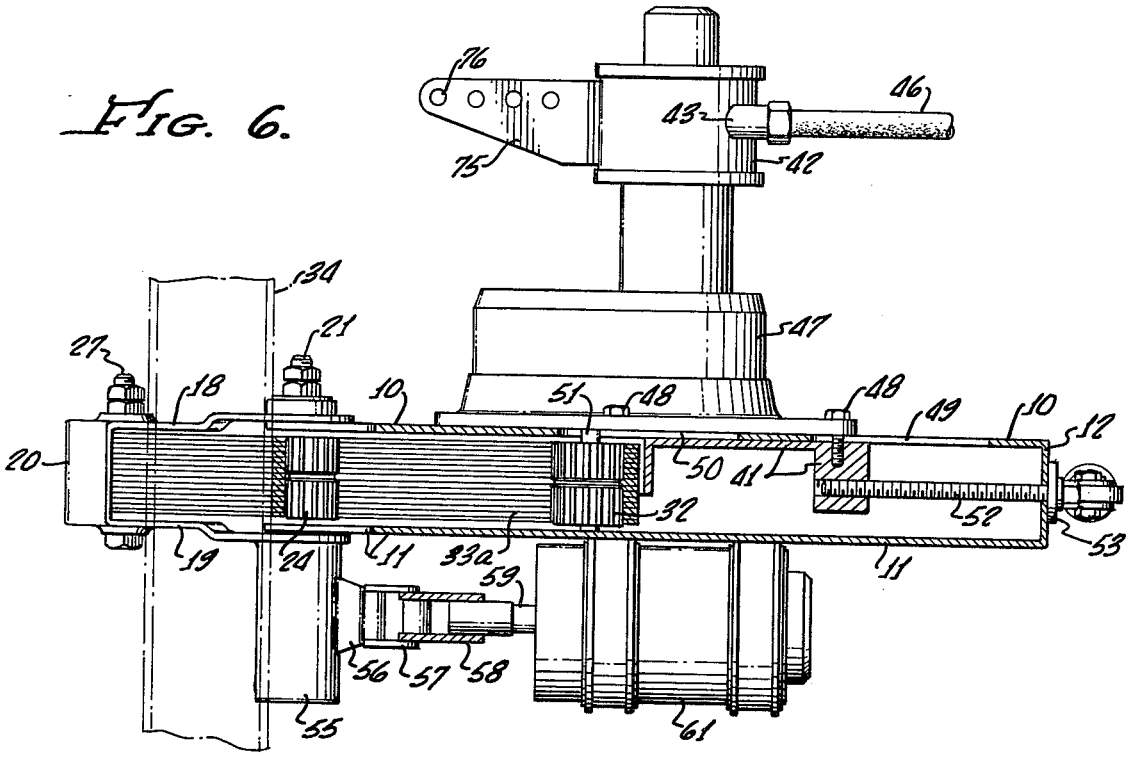
FIG. 6 is a vertical sectional view on line 6—6 of FIG. 3.

The shaft of rotary pneumatic motor 42 connects to appropriate reduction gearing which is contained within a cylindrical gear box 47 mounted centrally on the upper housing plate 10. Mounting of the gear box is effected by means of three lock screws 48 which extend downwardly through slots 49 in wall 10 and are threaded into the chain guide and lock element 41 (FIGS. 6–8). The output shaft 51 of gear box 47 extends downwardly through another and corresponding slot 50 (FIG. 6) in wall 10, and has the drive sprocket wheel 32 keyed thereon.

With the described construction, loosening of the various screws 48 permits the entire gear box 47 (and motor 42) to be moved toward or away from the pipe 34. Thus, the axis of output shaft 51 moves toward or away from the pipe, causing the drive sprocket wheel 32 to adjust the chain 33 for different diameters of pipe 34. It is emphasized that movement of the axis of drive sprocket wheel 32 is not for the purpose of tightening the chain on the pipe 34, since this is effeced (after the axis of shaft 51 is locked) by pivotal movement of the jaws as described below.

To shift the element 41 (and thus the connected gear box and pneumatic motor), an adjustment screw 52 (FIG. 6) is mounted longitudinally of the housing and is rotatably passed through end wall 12 of the housing. The screw 52 is threaded into a dependent portion of element 41, and is adapted to be turned (after loosening of lock screws 48) in order to adjust the location of the axis of the drive sprocket wheel. It is emphasized that the screw 52 does not bear any load, all load instead being borne by the lock screws 48 which (when tightened) effect frictional gripping of element 41 into close binding relationship with the upper housing wall 10. The outer end of screw 52 is associated with a suitable thrust bearing 53, and is adapted to be turned by a wrench or ratchet.

There will next be described the means for pivoting jaws 16 and 17 about pivot bolts 21 in order to tighten the chain 33 on pipe 34. As shown in FIG. 9, a tubular extension 55 is welded in dependent relationship on each jaw around boss portion 22 thereof. A crank arm 56 is welded on each extension 55, and extends inwardly toward the vertical medial plane of the apparatus for connection through links 57 to parallel drive plates 58 (FIGS. 4 and 6). The drive plates 58 are, in turn, pivotally connected to the piston rods 59 of a pair of double-acting pneumatic cylinders 61 which are fixedly mounted beneath housing wall 11 as shown in FIG. 4. The cylinders extend parallel to the indicated medial plane, on opposite sides thereof.

Because of the presence of the linkage means 57 and 58, the forces exerted by pneumatic cylinders 61 (which are constructed identically to each other) are transmitted equally to the crank arms 56 and thus to the jaws 16 and 17 to operate the latter. Very strong forces are thus transmitted to the jaws to close the same on the pipe 34, so that the inner edges 37 (bearing edges) of the leaf-links of chain 33 are forced into very heavy pressure engagement with the external pipe surface. Such pressure engagement results from the creation of great tension in the chain.

The inverse internal portion of the chain engages the exterior pipe surface about a majority of the circumference of such surface but not about the full circumference. When the jaws are thus in closed condition, they maintain the pipe in position in the inverse internal portion of the chain.

PNEUMATIC VALVE AND CIRCUIT MEANS

A rectangular valve and conduit housing 62 is mounted on one side wall 14 of the main housing, and has two valves 63 and 64 mounted therein. One of the valves, number 63, is a normally closed air valve (for example, a button valve) which is operated by handle means and which is connected in an air circuit which includes hose 46, as shown in FIG. 11. The air circuit further includes an air pressure tank 66 which is supplied with air by a suitable compressor means 67. Thus, when valve 63 is shifted to open position, air flows from the tank 66 to hose 46 and thus to one side of pneumatic motor 42. This operates through the gear means (in box 47) to drive the shaft 51 and thus drive sprocket wheel 32 and chain 33 for spinning of pipe 34. Although such operation depletes the air pressure in tank 66, the compressor 67 automatically starts to again build up the air pressure in the tank. However, there is a lag between the depletion of the tank pressure and the subsequent building up thereof, which lag is rendered of no substantial effect by the valve means 64 next to be described.

Valve 64 is schematically represented in FIG. 11 to comprise a three-position valve which is spring-biased to a central position at which no air may flow either into or out of the air cylinders 61. One fitting (port) on valve 64 connects through a line 68 to tank 66, whereas another fitting 69 vents to the atmosphere. The remaining two fittings of valve 64 respectively connect to lines 71 and 72 which lead to opposite ends of the air cylinders 61.

When the operator intentionally shifts the valve 64 in one direction away from the central position (at which central position it is maintained by a spring until intentionally shifted therefrom), air flows into one set of corresponding ends of the air cylinders 61 to thereby close the jaws 16 and 17. Conversely, when the valve 64 is shifted in the opposite direction away from the indicated central position, the flow direction is reversed so that air cylinder means 61 effects opening of the jaws 16 and 17.

Because of the fact that the valve 64 includes a central position which does not permit any leakage of air from either of conduits 71 and 72, that is to say which locks the air in cylinders 61, there is no depletion of the air in cylinders 61 despite the fact that the tank pressure 66 is depleted due to operation of the air motor 42. This is an important function because, otherwise, the pressure in the air cylinders 61 might sometimes lower to such value that the pipe would be inadequately gripped.

Valve 64 may be of various types known in the art and which include "locked" central positions, one suitable valve being manufactured by Barksdale Valve Company, Los Angeles, Calif., under Model No. 9083SOAC3-MC.

DESCRIPTION OF THE METHOD

The pipe-spinning apparatus is suspended at the wellhead of an oil well (or at another region where spinning is to be effected) by means of a support cable (not shown) which is connected to a support bracket 75 welded on motor 42. Bracket 75 is provided with a plurality of openings 76 in order that the apparatus may be supported in relatively level condition regardless of the adjusted position of the gear box 47 and associated parts.

Let it be assumed that the apparatus is to be used in "spinning-up" (namely, forming or making joints in) sections of drill pipe 34 (it being understood that a long length of drill pipe is already supported in the well). Accordingly, the hose 46 is connected to the appropriate one of air ports 43 and 44, to effect operation of the chain 33 in the correct direction to spin drill pipe 34 to make (complete) the joint instead of break it.

Valve 64 is then operated to its position effecting opening of jaws 16 and 17 to the condition shown in FIG. 7, following which the spinning apparatus is moved laterally until the drill pipe 34 is engaged by the region of chain portion **33*b* closest to drive sprocket wheel 32. It is pointed out that this operation is readily effected, since (as shown in FIG. 7) the chain portion 33*b* is not taut or spring tensioned but instead is loose and is open to receive the drill pipe 34**.

Valve 64 is then moved to the opposite position, thus causing closing of jaws 16 and 17 to the condition shown in FIG. 8. The degree of closing should be such that the adjacent portions of the return-bent portions **33*c*** of the chain are close to each other.

When the apparatus is first set up to spin a drill pipe 34 of a predetermined diameter, the axis of shaft 51 for drive sprocket wheel 32 is adjusted in position in order that there will be sufficient chain available to permit jaws 16 and 17 to close to the extent indicated in the preceding paragraph (namely, until the return-bent chain portions **33*c* are close together). Such adjustment is effected by loosening the lock screws 48 and then rotating adjustment screw 52 to the extent and in the direction necessary to achieve the stated result. Screws 48 are then re-tightened, thus preventing further movement of the axis of shaft 51. Once the apparatus is thus initially adjusted, it need not be further adjusted until pipe of a different diameter is to be spun. Small variations in the pipe diameter are compensated for by small variations in the extent to which the jaws 16 and 17** close on the pipe.

The method also comprises correlating the air pressure in cylinders 61 to the torque arm (arms 56, etc.) lengths, and other parameters, in such manner that the pipe 34 will be effectively and rapidly spun-up as the chain 33 is driven, and also in such manner that there will be slippage between the pipe 34 and the chain 33 as soon as the joint "seats" (bottoms out). This slippage provides a clutch action and (due to the characteristics of the silent chain 33) does not injure the pipe in any substantial amount. Because of the slippage or clutch action, there is no sudden locking and jarring action which tends to damage the apparatus and possibly injure the workers operating the same.

To aid further in this clutching action which results when the joint seats, the present apparatus is connected to a fixed support (schematically represented at 77 in FIG. 1) by means of a helical tension spring 78. The spring 78 prevents rotation of the spinning apparatus while the pipe 34 is being spun-up. As soon as the joint seats, the spinning apparatus attempts to rotate in a direction opposite to that in which the pipe was spun. However, such rotation is prevented by the spring 78 in a smooth, resilient, non-jaarring manner which cooperates with the clutch action between the silent chain 33 and pipe 34 to prevent damage to the apparatus or injury to the operators.

A safety cable 79 extends through spring 78, and is sufficiently slack to prevent interference with the described operation of the tension spring.

As soon as the joint has been spun-up, valve 64 is operated to cause cylinders 61 to open jaws 16 and 17, following which drill the pipe 34 is lowered further into the well. The operation is then repeated with another section of pipe.

It is pointed out that the present apparatus is adapted to be employed in conjunction with conventional tongs or other high-torque, low-speed devices for making and breaking the joints. The present apparatus normally operates in a relatively high-speed manner, for example to spin the pipe 34 at about 125 rpm (average).

When it is desired to "spin-out" sections of the drill pipe, it is merely necessary to disconnect hose 46 from the one air port 43 or 44, and connect it to the other. The operation of the air motor is therefore reversed to reverse the direction of driving of chain 33.

Because of the fact that the axis of drive sprocket wheel 32 is tightly locked against lateral shifting, by means of the friction screws 48, it is possible to create very high bearing pressure between the chain 33 and pipe 34. This is to be contrasted with the situation which would result if the axis of wheel 32 were only maintained in position by a tension spring of reasonable size, in which event closing of jaws 16 and 17 to a great extent would merely pull the spring (instead of greatly tensioning the chain) and therefore would limit the amount of tension which could be created in the chain and thus the amount of pressure which could be applied to the pipe 34 by the chain. This, in turn, would lessen the torque which could be created.

It is pointed out that the present apparatus may be employed to spin various sizes (diameters) of pipe, drill collars, etc., by merely loosening the screws 48 and employing the adjustment screw 52 (FIG. 6) to adjust the chain. Such things as well casing, etc., may also be spun. If desired, very high torques may be created with the present apparatus, particularly if the silent chain is caused to be very wide and if there is a very large gear reduction between the pneumatic motor 42 and the drive sprocket wheel 32. It is also pointed out that the pneumatic motor 42 could be replaced by hydraulic means in order to increase torque capabilities.

Because of the fact that the piston rods 59 for pneumatic cylinders 61 are connected (FIG. 4) to jaws 16 and 17 by linkage means 57 and 58, the jaws close simultaneously, with equal pressures and through equal angles. This is a distinct aid in creating uniform, proper bearing pressure on the pipe 34 by silent chain 33.

ANALYSIS OF THE SPROCKET AND PIVOT AXIS POSITIONS

It is emphasized that the chain 33 is in direct contact with the exterior surface of drill pipe 34, in contrast to certain prior-art constructions wherein various elements (such as blocks, collars, etc.) are interposed between a chain (or other flexible drive element) and a drill pipe. It is also emphasized that there are five sprocket wheels for the chain 33, in contrast with numerous (but not all) prior-art constructions wherein there are only three sprocket wheels (the drive sprocket and two idlers).

Important relationships relative to the pivot locations, the degree of jaw closing, etc. are best understood in reference to the highly schematic views 12 and 12*a*.

Figure 12:
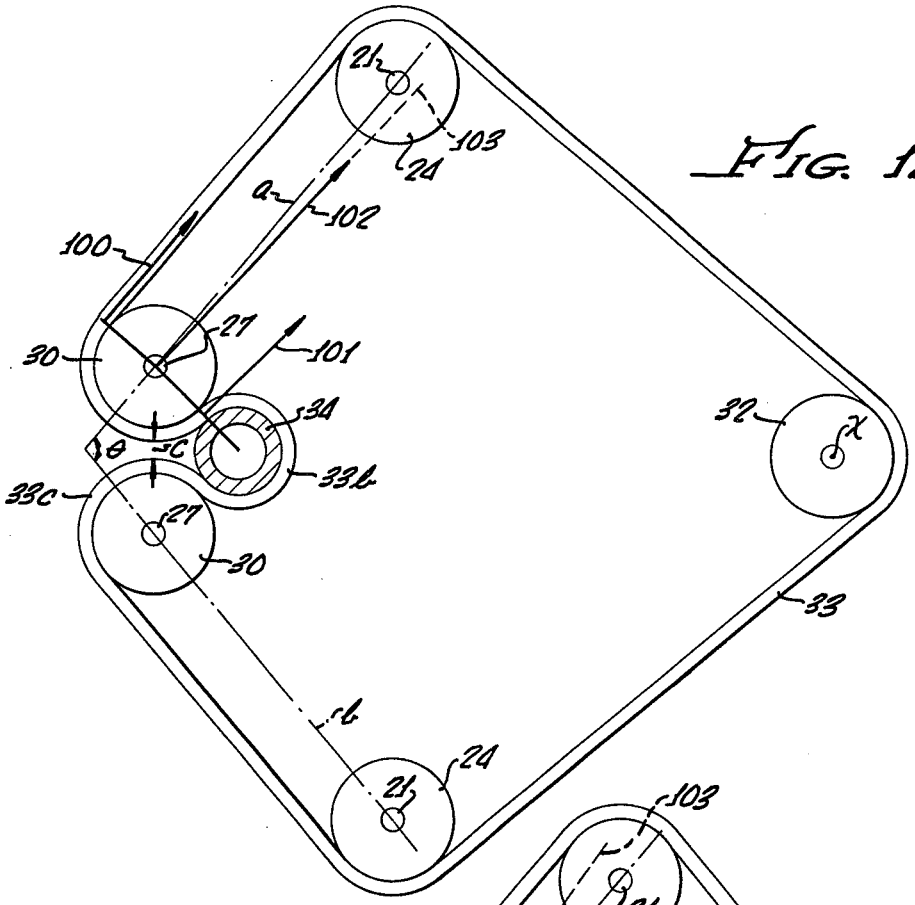
FIG. 12 is a schematic vector and torque diagram showing a pipe diameter such that an increase in chain tension increases the jaw-closing force; and FIG. **12*a*** is a corresponding vector and torque diagram showing a pipe diameter such that an increase in chain tension decreases, but not greatly, the jaw-closing force.
Figure 12A:
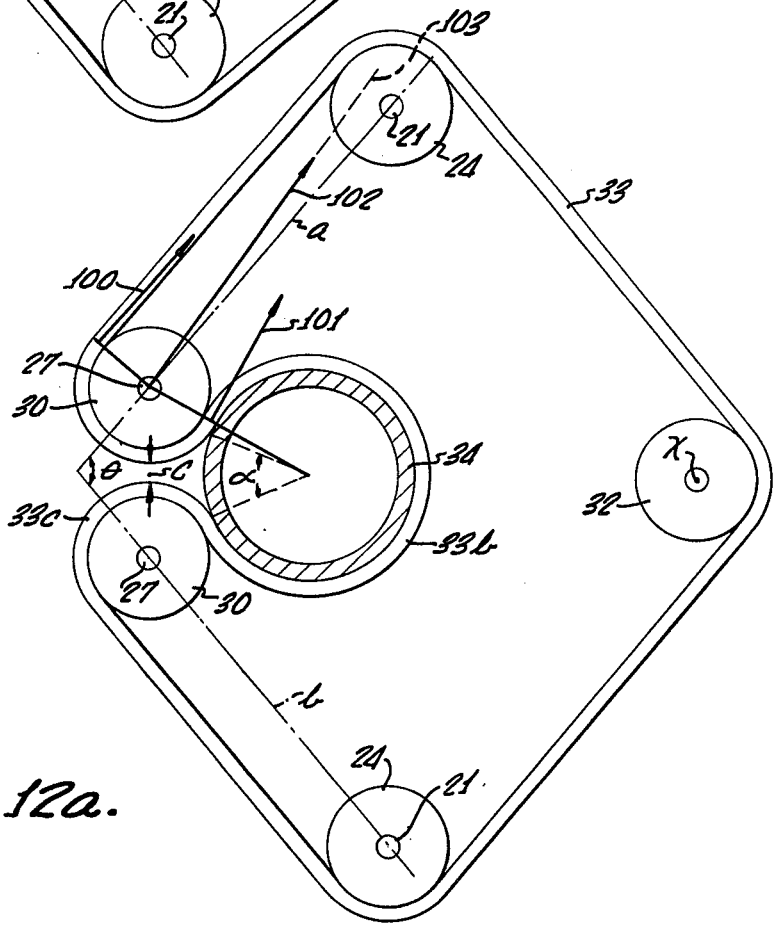

When the jaws 16 and 17 are in closed condition, the sprocket wheels 30 at the jaw ends are (in accordance with the present method) caused to be relatively close to each other, preferably being sufficiently close that the adjacent regions of the chain portions 33*c* are about one inch apart or even less (distance "*c*" shown in FIGS. 12 and 12*a*). Also, when the jaws are in closed condition, chain 33 engages pipe 34 over at least about 300 degrees of the circumference thereof. Thus, angle "alpha" shown in FIG. 12*a* is therefore about 60° or less. (Such angle "alpha" depends not only upon the distance "*c*", but upon the diameter of each sprocket wheel 30, which diameter is preferably between 3 and 4 inches in the specific example given below.)

Another important relationship is that the included angle between the jaw axes, when the jaws are in their closed condition, is large. Referring to FIG. 12, the included angle denoted is "theta" and is the angle between lines "*a*" and "*b*". Line "*a*" extends through the two pivot bolts 21 and 27 on jaw 17, whereas line "*b*" extends through the two pivot bolts on jaw 16. It is pointed out that the angle theta is on the side of lines "*a*" and "*b*" which is adjacent the drive apparatus, not the side remote therefrom.

To state the above more definitely, the angle theta is at least 80°, and is preferably greater than 90°. Very desirably, angle theta is on the order of 100° to 110° and even more. It is emphasized that angle theta is the angle which is present when the jaws are closed to the extent indicated above.

Although angle theta varies with pipe diameter, the degree of jaw closing and the locations of bolts 21 are (in accordance with the present apparatus and method) so selected that theta is in the specified range for all diameters of pipes spun by the present tool.

Another relationship to be noted is that the jaws 16 and 17 are relatively long in comparison to the diameter of pipe 34. Thus, the distance between pivot bolts 21 and 27 of each jaw 16 and 17 is much greater than the pipe diameter, and is (for many pipe sizes) at least a plurality of times the pipe diameter, as indicated in the drawing.

The described sprocket wheel, pivot and closing relationships create a number of important and desirable results. One such result is that the closing of jaws 16 and 17 produces a large degree of tightening of the chain portion 33*b* which actually engages pipe 34. Such tightening of chain portion 33*b* is very important in creating friction with the pipe, and is caused by the closing of the jaws and also by locking the axis "*x*" of the drive sprocket wheel 32 against movement in a direction toward the pipe.

It will be noted that if the sprocket wheels 30 were (when the jaws are fully closed) on diametrically-opposite sides of the pipe, and were pivoted perpendicularly toward the pipe to press the chain against diametrically-opposed parts of the pipe surface, closing of the jaws would create no tendency toward tightening of the chain portion 33*b*. The farther the sprocket wheels are away from such engagement of the pipe at diametrically-opposite parts thereof (and the closer the adjacent regions of chain portions 33*c* come together at gap "*c*"), the greater is the tendency whereby forcible closing of the jaws tightens chain portion 33*b* and thus creates a great deal of frictional force on the pipe surface.

Causing the adjacent regions of chain portions 33*c* to be close together at gap "*c*" also produces the very desirable effect that the pipe 34 is relatively locked in position and cannot readily pass forwardly through the jaws. Stated otherwise, the jaws act as effective gates preventing the chain from "climbing off" the pipe, which is an important feature of the present apparatus. For this and other reasons, it is not necessary to resort to a prior-art expedient of causing some locking means to connect the distal regions of the jaws. In other words, there is no necessity of connecting mechanically and directly to each other the jaw ends adjacent pivot bolts 27, as by connecting or locking links which must be removed prior to each opening of the jaws and which must be locked after each closing thereof with much wastage of labor.

Because the angle theta (FIGS. 12 and 12*a*) is large as indicated above, and because of other previously-stated relationships, the tightening of chain 33*b* caused by driving thereof by pneumatic motor 42 creates only a small tendency toward causing the jaws to open and permit the chain to climb off the pipe. In fact, for some smaller diameters of pipe the tightening of the chain in response to driving thereof effects a tendency toward closing the jaws instead of toward opening thereof.

To explain the above, the referring to FIGS. 12 and 12*a*, it is pointed out that there is one chain component of force (indicated at 100) which extends along the chain section which is parallel to line "*a*" or "*b*", along the outside of each jaw. Another component of force (numbered 101) is perpendicular to a line drawn from pivot bolt 27 to the center of the pipe 34. The vector sum of forces 100 and 101 acts at bolt 27, and is shown at 102. When the pipe is large, as indicated in FIG. 12*a*, the resultant vector 102 lies on a line (103) which passes outside the pivot axis 21. This means that driving of the chain produces a moment (torque) tending to open the jaws. However, because of the large angle theta, and other factors described above, this jaw-opening moment is not great.

When the pipe diameter is small, as shown in FIG. 12, resultant 102 lies on a line 103 which passes on the inside of pivot axis 21. This means that driving of the chain produces a force tending to close the jaws.

It follows that the indicated large angle theta, and the indicated small gap "*c*", cooperate to minimize the tendency for the jaws to open in response to driving of the chain. By increasing the angle theta (FIG. 3), the resultant vector 102 can be caused to pass on the inside of each pivot axis 21 even for larger diameter pipes. Driving of the chain would then always produce a jaw-closing force instead of a jaw-opening force.

It is to be noted that there must be some means (such as pneumatic cylinders 61) to close the jaws, even if the driving of the chain produces a jaw-closing force, since such jaw-closing force is dependent upon chain friction which is in turn dependent upon initial closing of the jaws by the cylinder means 61.

SPECIFIC EXAMPLE

The following specific example is given by way of illustration and not limitation, since the scope of the invention is to be determined by reference to the appended claims.

The illustrated pipe spinner may be of such size (for example) that it will spin tool joints in the range of $2\frac{7}{8}$ inches outer diameter to seven inches outer diameter, depending upon the adjusted position of the drive sprocket wheel 32. The exemplary apparatus is adapted to spin the pipe at about 125 rpm (average, since the rpm varies in accordance with pipe diameter).

The distance between the two pivot bolts 21 and 27 in each of the jaws 16 and 17 is 10 inches. The length of each crank arm 56 (FIG. 4) is $9\frac{1}{4}$ inches. Each of the two cylinders 61 has an inner diameter of 6 inches. The air pressure introduced into each cylinder is 125 psi gauge.

The pneumatic motor 42 is supplied with air at 125 psi gauge (at the beginning of the operation, but it decreases somewhat as stated above). The degree of gear reduction between the shaft of motor 42 and the shaft 51 of drive sprocket wheel 32 is 24 to 1.

The silent chain 33 is $3\frac{1}{8}$ inches wide. The distance between each chain pivot pin 39 and the adjacent pivot pin (FIG. 10) is $\frac{3}{4}$ inch. The pitch diameter of each of the idler sprocket wheels 24 and 30 is about $3\frac{3}{4}$ inches. The pitch diameter of drive sprocket wheel 32 is $3\frac{1}{4}$ inches.

The pipe-spinning torque generated is about 1,200 foot pounds.

The foregoing detailed description is to be clearly understood as given by way of illustration and example only, the spirit and scope of this invention being limited solely by the appended claims.

I claim:

1. Apparatus for spinning pipe, which comprises:

(a) first and second sprocket wheels, (b) a chain, said chain being a closed loop having an external portion and also having an inverse internal portion disposed within said external portion, said external and internal chain portions connecting to each other at return-bent portions which are respectively meshed with said first and second sprocket wheels and bend therearound, said chain having a large number of leaf-links the end portions of which are pivotally connected to the end portions of adjacent links, each of said leaf-links having teeth on one side thereof adapted to mesh with said sprocket wheels, each of said leaf-links having an elongated bearing edge on the other side thereof adapted to engage the exterior surface of a pipe to be spun, (c) means to effect relative movement between the axes of said sprocket wheels to thereby cause said wheels to be either relatively remote from each other or relatively adjacent each other, said last-named means being such that when said wheels are relatively remote from each other said pipe may be passed laterally between said wheels and into surface engagement with said bearing edges of said leaf-links in said internal portion of said chain, said last-named means also being such that when said wheels are relatively adjacent each other said bearing edges of the leaf-links in said internal portion of said chain are in surface engagement with a major portion of the circumferences of said pipe, and (d) means to drive said chain to thereby spin said pipe, said drive means comprising a drive sprocket wheel meshed with said chain, and means to lock the axis of said drive sprocket wheel in a fixed position when a pipe of predetermined diameter is being spun by said apparatus.

2. The invention as claimed in claim 1, in which means are provided to release said lock means and to shift said drive sprocket wheel axis in order to adapt the pipe-spinning apparatus for spinning pipes having different diameters, following which said lock means is relocked.

3. A pipe spinning apparatus, which comprises:
(a) support means,
(b) first and second jaws,
(c) means to pivotally connect one end of said first jaw to said support means,
(d) means to pivotally connect one end of said second jaw to said support means at a point spaced a major distance from said one end of said first jaw,
(e) first and second wheels mounted, respectively, adjacent said one end of said first jaw and said one end of said second jaw,
(f) third and fourth wheels mounted, respectively, adjacent the other end of said first jaw and the other end of said second jaw,
said other ends of said first and second jaws being disposed relatively close to each other when said jaws are in a predetermined closed condition,
all of said wheels being rotatable about axes which are substantially perpendicular to a plane,
said axes of said wheels so located that a first line parallel to said plane and passing through said axes of said first and third wheels lies at an included angle relative to a second line parallel to said plane and passing through said axes of said second and fourth wheels,
said included angle being on the side of said lines relatively adjacent said support means and being at least about 80° when said jaws are in said predetermined closed condition,
(g) a flexible drive element mounted in said plane,
said flexible drive element being a single closed loop having an external portion and an inverse internal portion,
said internal portion being on the side of said third and fourth wheels relatively adjacent said support means, and connecting to said external portion at return-bent portions which bend respectively around said third and fourth wheels,
the sections of said external portion which are respectively adjacent said third and fourth wheels extending respectively therefrom along the sides of said first and second lines remote from said support means, and then engaging said first and second wheels,
(h) means to drive said flexible drive element, and
(i) actuating means to open and close said jaws,
said actuating means pivoting said jaws between said predetermined closed condition, at which said internal portion of said flexible drive element is under a large tension and is engaged directly with the outer surface of a pipe to be spun, and an open condition at which said pipe may pass laterally between said return-bent portions.

4. The invention as claimed in claim 3, in which the axes of said first and second wheels are respectively coincident with said means to pivotally connect said jaws to said support means.

5. The invention as claimed in claim 3, in which said third and fourth wheels are disposed sufficiently close to each other, when said jaws are in said predetermined closed condition, that the gap between said return-bent portions is about one inch.

6. The invention as claimed in claim 3, in which said third and fourth wheels are sufficiently small in diameter, and are sufficiently close to each other when said jaws are in said predetermined closed condition, that said flexible drive element is in surface engagement with at least about 300° of the exterior surface of said pipe when said jaws are in said predetermined closed condition.

7. The invention as claimed in claim 6, in which the distance in said plane between the axes of said first and third wheels is equal to the distance in said plane between the axes of said second and fourth wheels, such distance being much greater than the diameter of the pipe to be spun.

8. The invention as claimed in claim 7, in which said distance is a plurality of times the diameter of the pipe to be spun, and in which said included angle is at least 90°.

9. The invention as claimed in claim 3, in which said means to drive said flexible drive element comprises a power-operated drive wheel mounted on said support means and engaged with said flexible drive element, in which means are provided to maintain the axis of said drive wheel fixed in position during operation of the apparatus to spin any given diameter of pipe, and in which said flexible drive element is substantially unstretchable.

10. The invention as claimed in claim 9, in which means are provided to adjust the position of said drive wheel axis to thereby adapt the apparatus for spinning a pipe of different diameter, and in which said means to maintain the axis of said drive wheel fixed in position comprises releasable lock means.

11. The invention as claimed in claim 3, in which said flexible drive element is a chain, and in which said wheels are sprocket wheels meshed with said chain.

12. The invention as claimed in claim 11, in which said chain is a silent chain.

13. Apparatus for spinning pipe, which comprises:
(a) support means,
(b) first and second jaws pivotally mounted on said support means,
(c) a substantially unstretchable closed-loop flexible drive element,
(d) wheel means to mount said flexible drive element on said support means and on said jaws,
said wheel means including first and second wheels respectively mounted at the outer ends of said jaws,
said wheel means causing said flexible drive element to have an external portion and an inverse internal portion,
said external portion and said internal portion connecting to each other at return-bent portions which bend respectively around said first and second wheels,
said wheel means further including a power-operated drive wheel rotatably mounted on said support means and engaged with said external portion of said flexible drive element,
(e) means to adjust the position of the axis of said drive wheel to thereby change the size of said internal portion of said flexible drive element and thus adapt the apparatus for spinning pipes of different diameter,
(f) means to effectively lock said axis in any of various adjusted positions, and
(g) means to apply a large amount of closing pressure to said jaws, to thereby forcefully close the same when said pipe is encompassed by and engaged by said internal portion of said flexible drive element, said large closing pressure shifting towards each other said first and second wheels, thus effecting a high degree of tensioning of said internal portion to thereby create great friction between said internal portion and said pipe, said high degree of tension being possible because said flexible drive element is substantially unstretchable and because said axis of said drive wheel is locked.

14. The invention as claimed in claim 13, in which said support means includes a plate, in which a combination guide and lock element is mounted on one side of said plate, in which rotary chain-drive means are mounted on the other side of said plate, in which the output shaft of said rotary chain-drive means extends through a slot in said plate adjacent said guide and lock element, in which said drive wheel is mounted on said output shaft on said one side of said plate, and in which lock screws are extended through the housing of said rotary chain-drive means and through slots in said plate and are threaded into said guide and lock element, said lock screws and said combination guide and lock element being said means to lock said axis in any of various adjusted positions.

15. The invention as claimed in claim 14, in which said means to adjust the position of said drive wheel axis comprises a screw extending through a portion of said support means and threadedly associated with said combination guide and lock element, said screw being generally parallel to said support plate.

16. The invention as claimed in claim 14, in which said rotary chain-drive comprises a pneumatic motor and a gear box, and in which said lock screws extend through the housing of said gear box.

17. The invention as claimed in claim 13, in which said flexible drive element is a silent chain.

18. A method of spinning pipes having different outer diameters, which comprises:

(a) providing an apparatus incorporating first and second wheels on the outer ends of movable jaws, also incorporating a closed-loop flexible drive element having an external portion and an inverse internal portion which connects to said external portion at return-bent portions respectively bent around and engaged with said first and second wheels, and further incorporating at least one additional wheel in engagement with said drive element, (b) fixing the axis of said additional wheel in a first predetermined position, said first predetermined position being such that when a pipe having a first outer diameter is disposed within said inverse internal portion, closing of said jaws to a predetermined condition will create much tension in said flexible drive element and thereby create great friction between said internal portion and the outer surface of said pipe, (c) disposing within said internal portion said pipe having said first outer diameter, and closing said jaws to said predetermined condition creating much tension in said drive element, (d) driving said flexible drive element to spin said pipe, (e) moving the axis of said additional wheel to a second and different predetermined position and fixing said axis at said second predetermined position, said second predetermined position being such that when a pipe having a second and different outer diameter is disposed within said inverse internal portion, closing of said jaws to substantially said predetermined condition will create much tension in said flexible drive element and thereby create great friction between said internal portion and the outer surface of said pipe of said second outer diameter, (f) disposing within said internal portion said pipe having said second outer diameter, and closing said jaws to substantially said predetermined condition creating much tension in said flexible drive element, and (g) driving said flexible drive element to spin said pipe having said second outer diameter.

19. The invention as claimed in claim 18, in which said apparatus incorporates, as said flexible drive element, a silent chain, and incorporates sprocket wheels as said wheels.

20. The invention as claimed in claim 18, in which said additional wheel is disposed between said external portion and said internal portion and in engagement with said external portion, in which said method is so performed that the direction of movement of said axis of said additional wheel, in shifting between said first and second predetermined positions, is toward or away from said internal portion, and in which said method further comprises effecting said driving of said flexible drive element by rotating said additional wheel.

21. The invention as claimed in claim 18, in which said method further comprises causing said predetermined closed condition of said jaws to be such that said return-bent portions of said flexible drive element are only a short distance from each other.

22. The invention as claimed in claim 21, in which said short distance is about one inch.

23. A method of spinning-up the pipe used in an oil well, to form threaded joints between adjacent sections of pipe, which method comprises:

(a) providing on an apparatus a closed-loop chain having an external portion and an inverse internal portion, (b) suspending said apparatus at the wellhead of an oil well, (c) disposing said internal portion of said chain around an oil well pipe and in surface contact therewith, (d) creating sufficient tension in said chain to cause the friction grip between said chain and said pipe to be sufficiently great to permit effective and rapid spinning-up of said pipe by said chain, but insufficiently great to prevent slippage of said chain relative to said pipe when the joint bottoms, (e) providing resilient means between said apparatus and a fixed support to aid in shockless clutching when said joint bottoms, and (f) employing motor means to drive said chain and thus spin-up said pipe at a rapid rate of speed, whereby bottoming of said joint causes slipping of said chain on said pipe and does not injure or stall said motor means or other portions of said apparatus employed in performing said method.

* * * * *